United States Patent [19]

Sczerba

[11] 4,390,397

[45] Jun. 28, 1983

[54] HEAT DISSIPATING CHARGING HOLE COVER

[75] Inventor: Stanley T. Sczerba, McKeesport, Pa.

[73] Assignee: Koppers Company, Inc., Pittsburgh, Pa.

[21] Appl. No.: 334,656

[22] Filed: Dec. 28, 1981

[51] Int. Cl.[3] ..... C10B 25/20; C10B 25/24

[52] U.S. Cl. ..... 202/243; 202/247; 202/251

[58] Field of Search ..... 202/242, 243, 245, 247, 202/248, 250, 251; 49/463, 464

[56] References Cited

U.S. PATENT DOCUMENTS

| | | | |
|---|---|---|---|
| 2,203,698 | 6/1940 | Schmidt | 202/250 |
| 3,689,369 | 9/1972 | Tucker | 202/251 |
| 3,900,369 | 8/1975 | Irie et al. | 202/247 |

FOREIGN PATENT DOCUMENTS

| | | | |
|---|---|---|---|
| 2345143 | 3/1975 | Fed. Rep. of Germany | 202/251 |

*Primary Examiner*—Bradley Garris

*Attorney, Agent, or Firm*—Daniel J. Long; Herbert J. Zeh, Jr.; Oscar B. Brumback

[57] ABSTRACT

A coke oven charging hole that dissipates heat emanating from the oven so that the cover resists warping due to overheating. The concentration of large amounts of heat directly above the charging hole is also avoided. A lower concave housing member fits into the charging hole and is partially filled with insulation. A circular plate is fixed to this housing member so as to form an insulating air space between this plate and the insulation. One or more other plates are superimposed over this plate so as to form heat air spaces which are open to ambient air so that a laterally directed flow of air is established in these air spaces.

6 Claims, 3 Drawing Figures

HEAT DISSIPATING CHARGING HOLE COVER

BACKGROUND OF THE INVENTION

1. Field of the Invention

The present invention deals with coke ovens and, in particular, with coke oven charging hole covers.

2. Description of the Prior Art

Coke ovens are conventionally filled with coal in preparation for the coking process through a plurality of charging holes located on the battery top. The removable covers for these charging holes have generally consisted of a single cast iron plate which rests on a frame surrounding the charging hole so as to form a peripheral gravity seal around the charging hole where the cover contacts the frame. These plates, however, are known to reach such high temperatures during the coking process that they may tend to warp, and if such warping does occur they may no longer form a gas tight seal with the charging hole frame. The escape of pollutants from inside the oven may, therefore, result. Furthermore, because heat is conducted more efficiently through these cast iron charging hole covers than through other sections of the oven roof, it is believed that this cast iron construction is responsible for the occurrence of an undesirable concentration of heat directly above the covers. Various suggestions have been made for alleviating the above mentioned problems. U.S. Pat. No. 3,900,369, for example, proposes that a cover be constructed by bolting or otherwise fixing a preformed refractory plate section below an iron cover top section. While this cover would appear to reduce heat flow from inside the coke oven, it may under certain circumstances, be preferable, for cost and durability reasons, to employ a cover which is constructed mostly of metal but which still does not tend to become excessively hot or concentrate heat in the space directly above it. It is, therefore, the object of the present invention to provide a heat dissipating charging hole cover which has the above mentioned characteristics.

SUMMARY OF THE INVENTION

The present invention is a charging hole cover which was a lower concave insulation retaining element which is adapted in shape and size to fit into a charging hole. A circular plate caps this concave element and two other circular plates are remotely superimposed over the concave element, one over the other, so that two air spaces are formed thereabove. It is found that the above described arrangement tends to dissipate heat from the charging hole cover so that it will resist reaching excessive temperatures or concentrating heat in the space directly above it.

BRIEF DESCRIPTION OF THE DRAWINGS

The present invention is further described in the accompanying drawings in which.

DETAILED DESCRIPTION

Figure 1:
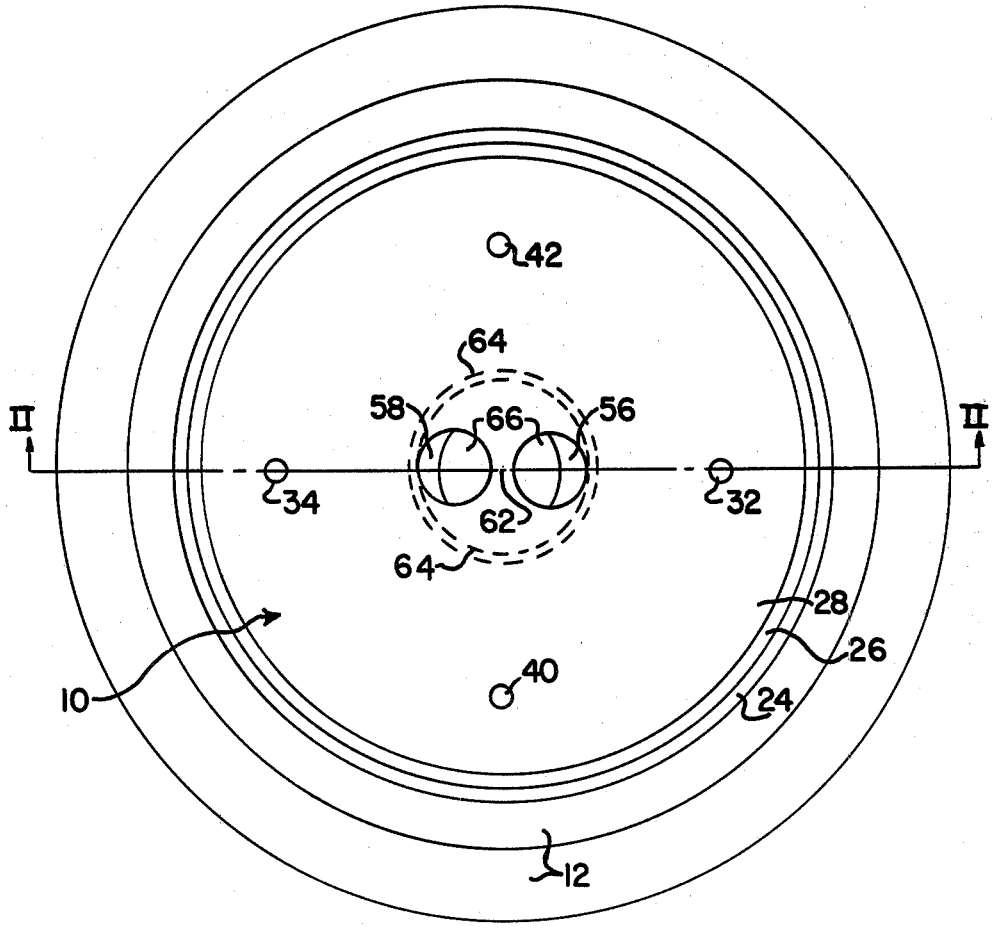
FIG. 1 is a plan view of the charging hole cover of the present invention.
Figure 2:
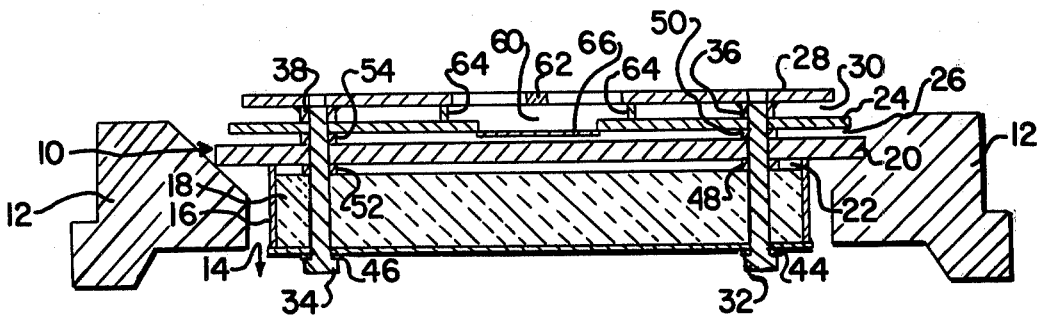
FIG. 2 is a cross sectional view of a charging hole cover of the present invention taken through line II—II in FIG. 1.

Referring to FIGS. 1 and 2, the charging hole cover of the present invention is shown in general at numeral 10. This charging hole cover 10 fits inside of the frame 12 of the charging hole 14 (FIG. 2). Referring particularly to FIG. 2, it will be seen that the charging hole 14 is directly covered by cylindrical concave insulation retaining element 16 which is adapted in size to fit into said hole. The concave element 16 is closed at its lower end so as to retain a layer of insulating material 18. At its upper end the concave element 16 is covered by a circular lower plate 20, and between the lower plate 20 and the insulating material 18 there is an air space 22. Superimposed over the lower plate 20 there is a circular medial plate 24. These plates are spaced from one another so that there is formed between them a heat dissipating air space 26. The air space 26 is open to ambient air so that air flows laterally through this air space and heat is continuously dissipated from the charging hole cover 10. Superimposed above and spaced from the medial plate 24, there is a circular upper plate 28. Between the medial plate 24 and the upper plate 28 there is an upper air space 30. This air space is open at its peripheral edge to ambient air so that air also flows through it so as to continuously dissipate heat from the charging hole cover. The entire assembly is held together by a plurality of bolts which pass through the insulation retainer 16 and the above mentioned circular plates. FIG. 2 shows that bolts 32 and 34 pass through aperatures in the botton section of the concave insulation retainer 16 and through the insulation 18. The bolts 32 and 34 also pass through aperatures in the lower plate 20, the medial plate 24 and the upper plate 28 and are retained, respectively, by nuts 36 and 38 which are welded to the upper plate. The heads of bolts 32 and 34 are also spaced, respectively, from the insulation retainer by washers 44 and 46. It will also be seen that the bolt 32 also passes through spacing element 48 and 50 and that bolt 34 passes through spacing element 52 and 54.

The charging hole cover 10 is preferably lifted by a magnetic lid lifter. Aperatures 56 and 58 are, however, provided in the upper plate 28 so that the charging hole cover may be lifted by a hook. Beneath these aperatures there is a hook receiving space 60 into which a hook may be inserted so as to engage bridge 62. The hook receiving space 60 is laterally bounded by a cylindrical wall 64 which abuts both plates 24 and 28 and which is shown in FIG. 1 in broken lines. This hook receiving space is also bounded on its lower end by a hook clearance plate 66.

Figure 3:
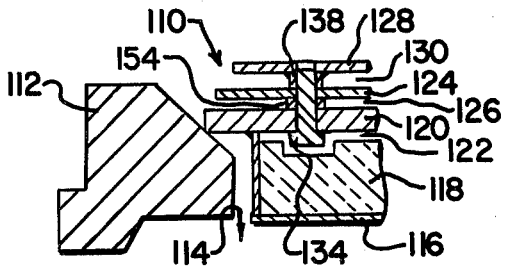
FIG. 3 is a fragmented view in vertical section of another embodiment of the present invention.

A second embodiment of the present invention is illustrated, in fragment, in FIG. 3. This embodiment is similar to the one described above except for the way in which the various parts of the cover are held together. It will be seen from FIG. 3 that the charging hole cover 110 rests on the frame 112 of a charging hole 114. The cover consists of a concave insulation retainer 116 which is filled with insulation 118. A lower circular plate 120 is superimposed over the insulation retainer and an air space 122 is formed between the insulation 118 and the plate 120. A medial circular plate 124 is superimposed above plate 120 so as to form air space 126. Finally an upper circular plate 128 is also superimposed over and spaced from plate 124 so that another air space 130 is formed between those plates. It will be seen that bolt 134 passes through aperatures in plates 120 and 124 and engages nut 138, which is welded to the upper circular plate 128. The bolt 134 also passes through spacing element 154 which separates plates 120 and 124. The insulation retainer 116 is also welded to the lower circular plate 120.

It will, therefore, be understood that there has been described a heat dissipating charging hole cover which will tend to maintain acceptable temperatures and which will be unlikely to concentrate excessive amounts of heat in the space directly above itself. Further, it is clear from the above description that the cover includes plate connecting structure such as the nut and bolt arrangement which performs a heat conducting function whereby heat is continuously removed from the lowermost plate and transmitted to the heat dissipating air spaces thereabove. Although the invention has been described with a certain degree of particularilty, it is to be understood that the present disclosure has been made only as an example and that the scope of the invention is defined by what is hereafter claimed.

What is claimed is:

1. A coke oven charging hole cover comprising:

(a) a lower concave housing member adapted to be received within the charging hole;

(b) an insulation layer retained within said concave housing member;

(c) a first circular plate superimposed over said concave housing member so that an insulating lower air space is formed between said first circular plate and the insulation layer;

(d) a second plate superimposed over said first circular plate in parallel, spaced relation such that a first heat dissipating air space, said space being open to ambient air, is formed between said first and second plates;

(e) a third plate superimposed over said second plate in parallel, spaced relation such that a second heat dissipating air space, said space being open to ambient air, is formed between said second and third plates; and (f) heat conducting means connecting the first circular plate with the second plate and the second plate with the third plate, such that heat is continuously removed from the first circular plate to the first and second heat dissipating air spaces.

2. The coke oven charging hole cover defined in claim 1, wherein at least one nut is fixed below said third plate and a bolt passes upwardly first through the lower concave housing member and the insulation layer and then through the first then second plates so as to engage the nut.

3. The coke oven charging hole cover defined in claim 1 wherein the lower concave housing member is welded to the first circular plate and wherein at least one nut is fixed below said third plate and a bolt passes upwardly first through said first circular plate then through said second plate so as to engage the nut.

4. The coke oven charging hole cover defined in claim 2 or 3 wherein the nut is welded to the third plate.

5. The coke oven charging hole cover defined in claim 2 or 3 wherein four nuts are fixed to the third plate, each of said nuts being spaced from adjacent nuts by ninety degrees and being engaged by a bolt.

6. The coke oven charging hole cover defined in claim 2 or 3 wherein the third plate has two adjacent hook receiving aperatures and wherein a cylindrical wall connecting the third and second plate surrounds an air space below said aperatures so as to form a hook receiving space.

* * * * *